United States Patent [19]

Balk

[11] Patent Number: 4,708,619

[45] Date of Patent: Nov. 24, 1987

[54] APPARATUS FOR SPINNING MONOFILAMENTS

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 834,626

[22] Filed: Feb. 27, 1986

[30] Foreign Application Priority Data

Feb. 27, 1985 [DE] Fed. Rep. of Germany ..... 3506924

[51] Int. Cl.[4] ..... D01D 1/09

[52] U.S. Cl. ..... 425/141; 264/40.2; 425/162; 425/382.2

[58] Field of Search ..... 264/22, 40.2, 176 F, 264/40.7, 177.13, 211, 211.12; 425/725, 140, 141, 145, 162, 174, 382.2, 464

[56] References Cited

U.S. PATENT DOCUMENTS

| | | | |
|---|---|---|---|
| 2,922,188 | 1/1960 | Bossen | 425/140 |
| 3,122,782 | 3/1964 | Moore | 425/141 |
| 3,394,206 | 7/1968 | Porebski et al. | 425/141 |
| 3,619,433 | 11/1971 | Windley | 264/176 F |
| 3,683,160 | 8/1972 | Windley | 425/162 |

*Primary Examiner*—Jay H. Woo
*Assistant Examiner*—J. Fortenberry
*Attorney, Agent, or Firm*—Karl F. Ross; Herbert Dubno

[57] ABSTRACT

Apparatus for spinning monofilaments made of thermoplastic synthetic resin, with a spinning head for monofilaments, at least one spinning panel with a plurality of nozzle orifices, one or more spinning pumps with a motor equipped with a regulator for controlling the thickness of the monofilaments. The regulator can be fed to the diameter measurements of the individually measured monofilaments. Anywhere from 6 to 60 nozzle orifices, preferably about 20 nozzle orifices, are combined into a nozzle orifice group. Each nozzle orifice group has its own spinning pump with its own regulator. The monofilaments of the nozzle orifices of a nozzle orifice group can be conducted past a measuring device for the measurement of the diameters of the monofilaments. This measuring device will calculate an average of the diameter measurements of the monofilaments, which can be fed as an actual value into the regulator which services the spinning pump of the corresponding nozzle orifice group.

6 Claims, 5 Drawing Figures

APPARATUS FOR SPINNING MONOFILAMENTS

FIELD OF THE INVENTION

My present invention relates to an apparatus for spinning monofilaments made of thermoplastic synthetic resin and, more particularly to a monofilament spinning apparatus which has a spinning head for the monofilaments with at least one spinneret with a plurality of nozzle holes or orifices, one or more electric-motor-driven spinning pumps and a regulator for controlling the thickness of the monofilaments.

BACKGROUND OF THE INVENTION

In an earlier apparatus for this purpose, all of the nozzle holes make up a single nozzle hole group. This can involve up to 120 nozzle holes. The spinning pumps service this group jointly and are jointly serviced by a single regulator, i.e. the pumps feed a single spinning head or spinneret.

From time to time the diameters of the individual monofilaments are measured in the laboratory. An attendant then feeds the measured values of diameter into the regulator in an appropriate manner.

Thus the attendant and the laboratory worker are needed to close the regulating cycle.

The regulation procedure is influenced considerably by the subjective estimate of this individual. Furthermore this procedure causes a significant delay or control-response lag time. This delay, the errors it causes, as well as the deviations in the diameters of the bundle of monofilaments, can be quite severe.

OBJECTS OF THE INVENTION

The principal object of my present invention is to provide an improved apparatus for the purposes described which can decrease significantly any deviations in the diameters of the individual product monofilaments.

Another object of this invention is to obviate the drawbacks of prior art devices for producing synthetic resin monofilament.

SUMMARY OF THE INVENTION

These objects and others which will become apparent hereinafter are attained in accordance with the invention in an apparatus of the type generally described but wherein each 6 to 60 nozzle holes or orifices, preferably about 20 nozzle holes or orifices, are combined into a group of nozzle holes, each spinneret has a plurality of such groups and each of the nozzle orifice groups has its own individual motor-driven spinning pump with its own pump regulator.

According to a feature of the invention the monofilaments from the nozzle orifices of a nozzle orifice group can be conducted through a measuring device which measures the diameter of at least some of the monofilaments and establishes an average of the diameters of the monofilaments of the group.

This average of the diameter measurements is then used as an actual value for the control operation and is fed to the regulator which services only the spinning pump of the respective nozzle hole group.

If it is postulated that in the usual apparatus a bundle of monofilaments corresponding to 160 nozzle orifices and if, in accordance with the invention, nozzle orifice groups of 20 nozzle orifices are formed, it can be seen that, surprisingly, the diametrical deviation of the bundles of monofilaments containing 20 monofilaments is reduced to about one quarter of the diametrical deviations of the individual monofilaments of the output bundle of 160 monofilaments.

Moreover the apparatus of the invention allows certain inaccuracies to be compensated for; for example, inaccuracies which stem from the temperature asymmetries of the spinneret of extrusion die, of the melting current supplied to the invention, and of the variations resulting from the position of the screen which is generally provided upstream of the nozzle plate.

Preferably the monofilaments from the nozzle orifices of a nozzle orifice group can be conducted through a measuring device which measures the diameters of the individual monofilaments and that the average can be calculated with the aid of a computer within or connected to the measuring device. This has the practical value of permitting the calculation of the algebraic average of the monofilaments of a nozzle orifice group (=sum of the diameters/number of monofilaments) and generating from this quotient a signal which can be fed as an actual value into the regulator assigned to the spinning pump.

Furthermore, it is within the scope of the invention to measure the diameters of the entire bundle of monofilaments corresponding to the number of nozzle orifices of the group, thereby obtaining the required average measurement immediately. The auxiliary accessories of modern measuring techniques can be applied to the measurement of the diameter of monofilaments or for other physical parameters of a monofilament bundle. For the instance it is possible to work with capacitive or other electric diameter monitoring devices.

One can also use laser measuring devices for the measurement of diameters. It is understood that, within the scope of the invention, the strictly geometrical measurements will be determined as electrical measurements or will be converted into the latter, in keeping with customary measuring and control techniques.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 1:
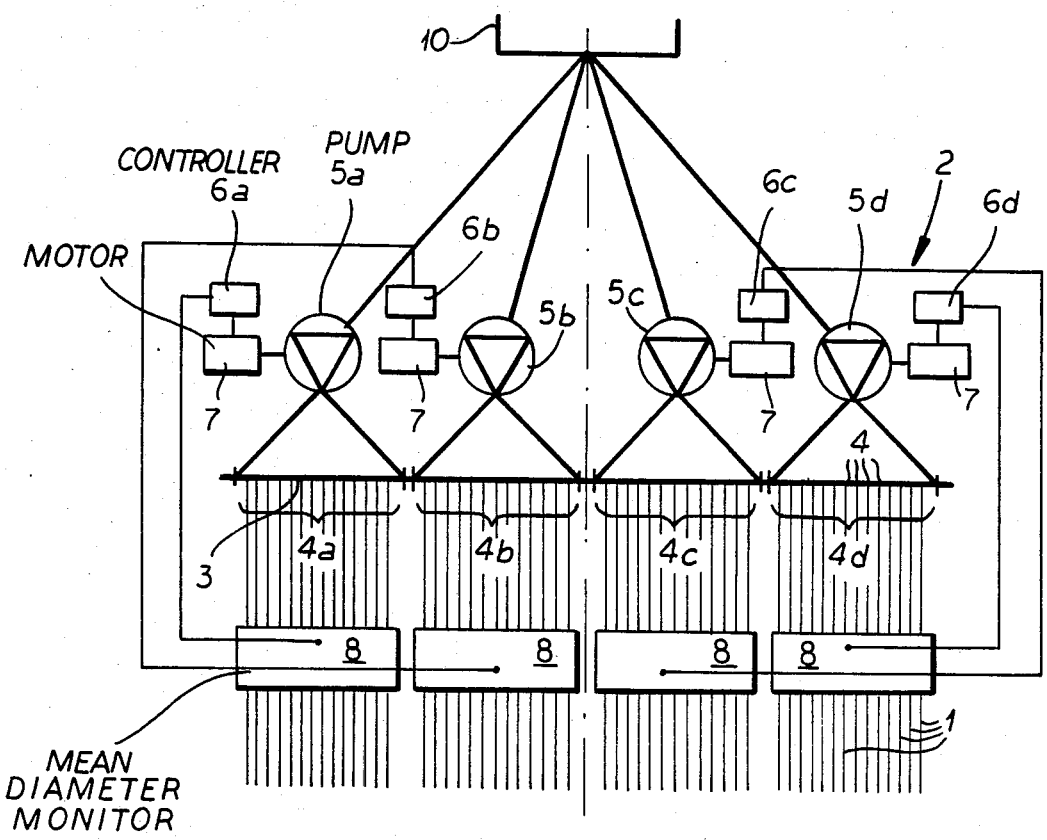
FIG. 1 is a diagram of the apparatus of the invention.

The apparatus shown in FIG. 1 is intended for spinning monofilaments 1 made of thermoplastic synthetic resin. The basic structure includes a spinning head for the monofilaments which has at least one but preferably a multiplicity of spinning plates or spinnerets 3 each with a plurality of nozzle orifices. Spinning pumps equal in number to the spinning heads draw from a synthetic resin supply 10.

Each spinning pump has a respective spinning pump motor 7 which is equipped with a regulator **6*a*–6*d*** to control the thickness of the monofilaments.

The average diameter measurements can be fed to the regulators **6*a*–6*d* of the individual monofilaments 1**.

At any given time there are from 6 to 60 nozzle orifices 4, in the design model there are about 20 nozzle orifices, combined in each nozzle orifice group 4*a*, 4*b*, 4*c*, 4*d* . . . .

Each of the nozzle orifice groups 4*a*, 4*b*, 4*c*, 4*d* . . . has its own spinning pump 5*a*, 5*b*, 5*c*, 5*d* . . . with its own regulator 6*a*, 6*b*, 6*c*, 6*d* . . . .

The monofilaments 1 from the nozzle orifices of a nozzle orifice group 4*a*, 4*b*, 4*c*, 4*d* . . . can be conducted past or through a measuring device 8 for the measurement of the diameters of the monofilaments 1. This measuring device 8 calculates an average of the diameters of the monofilaments or reads out a value of this average immediately.

This average of the diameter measurements can be fed as an actual value into the regulator 6A, 6*b*, 6*c*, 6*d* . . . which services the spinning pump 5*a*, 5*b*, 5*c*, 5*d* . . . of the corresponding nozzle orifice group 4*a*, 4*b*, 4*c*, 4*d* . . . .

In the embodiment shown the monofilaments 1 of the diameter orifices of a nozzle orifice group 4*a*, 4*b*, 4*c*, 4*d* . . . can be conducted past a measuring device 8 to measure the diameters of the individual monofilaments. Then the average will be calculated with the aid of a computer within this measuring device 8. Preferably the algebraic average will be used, but it is also possible to work with other averages.

Figure 2:
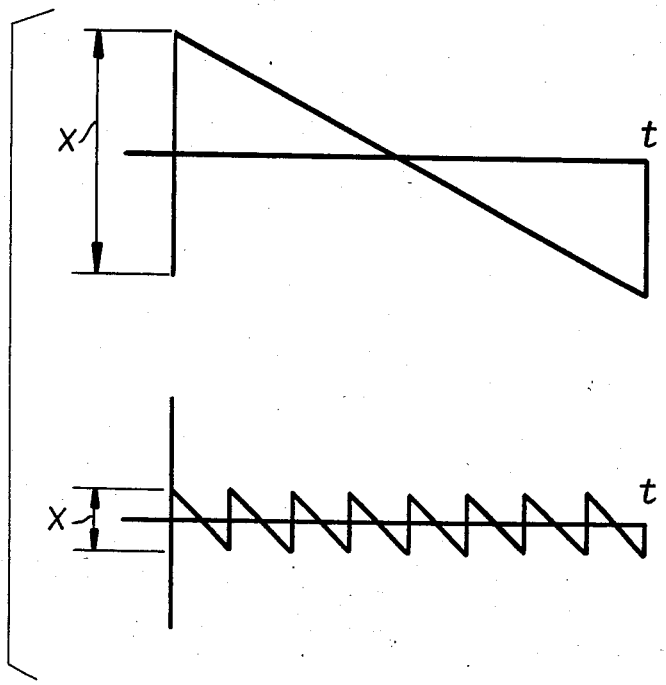
FIG. 2 is a set of graphs for explaining the effect achieved by the invention.

FIG. 2 clarifies the effect achieved by the invention. The ordinates show the deviations of the diameters X with a bundle of monofilaments, and the abscissa indicates the time t. FIG. 2, upper partial figure, portrays the behavior of the diameter deviations X, whenever a monofilament bundle of about 160 monofilaments is manufactured by the apparatus mentioned in the introduction as the state of technology. The lower partial figure shows what happens if, as per the invention, one forms nozzle orifice groups 4*a*, 4*b*, 4*c*, 4*d* . . . of for instance 20 nozzle orifices 4 and thereby forms monofilament bundles of 20 monofilaments. Within the same time period this procedure would reduce the diameter deviation X to about one quarter of the diameter deviation X of the individual monofilaments 1 of the output bundle of 160 monofilaments.

Figure 3:
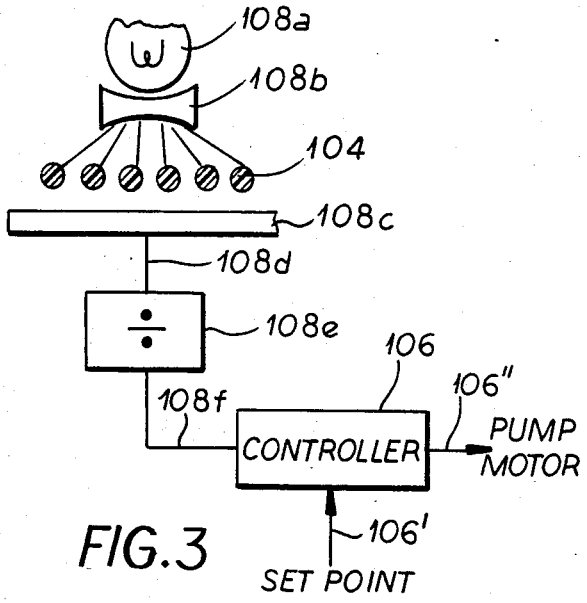
FIGS. 3–5 are diagrams representing sections transverse to the paths of the monofilaments illustrating features of the invention.

FIG. 3 shows an embodiment of the invention wherein the monofilaments 104 of each group pass between a light source 108*a* having a divergent lens system 108*b* to spread the light over the entire array. The light cast on the photosensitive plate 108*c* is thus proportional to the sum of the diameters of the monofilaments at each instant. The instantaneous value of this sum is represented by the signal delivered at 108*d* to a quotient forming device or divider circuit 108*e* whose output 108*f* represents the average diameter calculated by dividing the instantaneous value by the number of monofilaments of the group. The average signal 108*f* is supplied to the controller 106 individually to the group of monofilaments and separate from the other controllers. In accordance with conventional servomechanism practice, the controller 106 compares the actual value of the diameter average with a setpoint delivered at 106′ for this diameter and the output is then used to control the speed of the pump motor to maintain this average diameter substantially constant.

Figure 4:
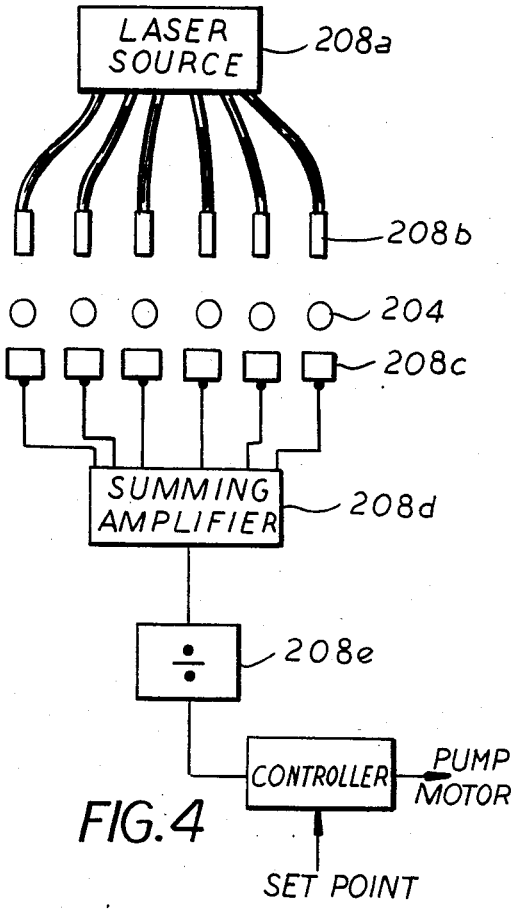

In FIG. 4 a laser source 208*a* delivers its light to fiber optical light pipes 208*b* disposed over the array of monofilaments 204. The array of sensors 208*c* then individually register intensities inversely proportional to the individual diameters and signals representing the diameter are then delivered to a summing amplifier 208*d* which feeds the diodes 208*e* for control of the pump motor as described in connection with FIG. 3.

Figure 5:
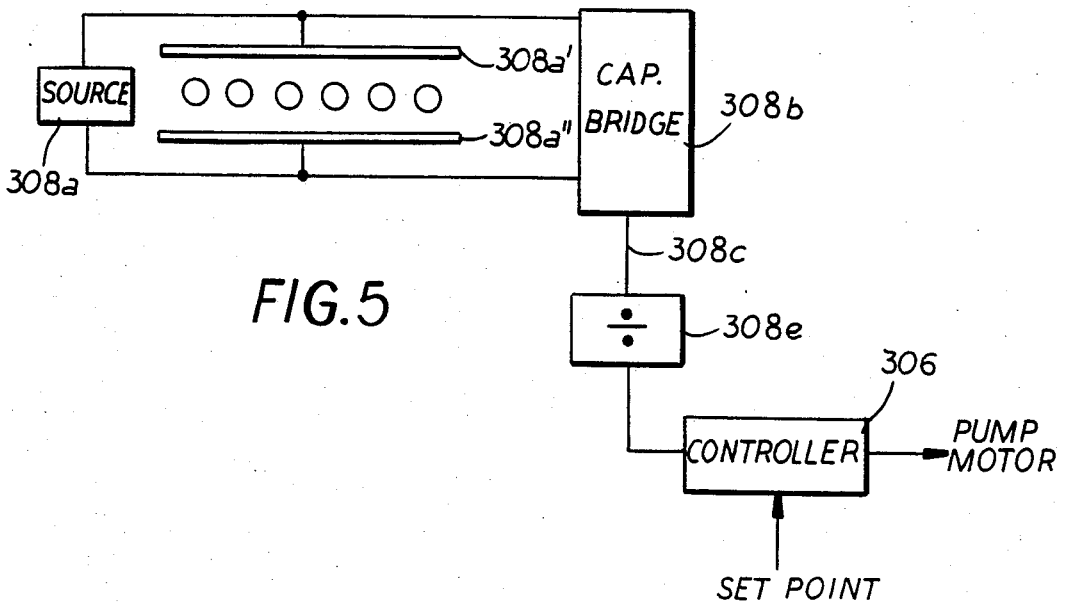

FIG. 5 shows a capacitive arrangement in which the array of monofilaments 304 passes between two capacitor plates 308*a*′, 308*a*″ to vary the capacitance across them. The plates can be provided with a suitable change by a direct current source 308*a*.

The capacitance is measured by a bridge 308*b* which outputs a signal 308*c* which represents the sum of the diameters of the monofilaments. This summation signal can be delivered to a divider 308*e* whose output is fed to a controller 306 for the pump motor.

In FIGS. 3, 4 and 5, the elements 108*e*, 208*e*, 308*e* of the respective diameter measuring units can be deemed part of the computer for calculating the average diameter values.

I claim:

1. An apparatus for spinning monofilaments from a thermoplastic synthetic resin which comprises:

a spinning head formed with a plurality of spinnerets each having a group of nozzle orifices, said spinnerets being fewer in number than the total number of orifices;

a respective pump connected to each of said spinnerets for feeding said synthetic resin to the nozzle orifices of the respective group;

a respective electric motor for driving the pump of each spinneret;

a respective diameter measuring unit positioned adjacent to each spinneret and located downstream of said orifices for monitoring the diameter of each mono-individual filament issuing from the orifices and means for providing an actual value signal representing an average of the diameters of monofilament monitored by said unit; and a respective controller connected to said unit and responsive to the respective actual value, and connected to the respective motor to control the pump of the respective spinneret to maintain the average value signal substantially constant.

2. The apparatus defined in claim 1 wherein said unit is connected with a computer for generating said actual value signal as an average of the diameters of the monofilaments of the respective spinneret.

3. The apparatus defined in claim 1 wherein said actual value signal is an algebraic average derived by summing the diameters of the monofilaments of the respective spinneret and dividing the resulting sum by the number of monofilaments of the spinneret.

4. In an apparatus for spinning thermoplastic synthetic resin monofilaments, comprising:

a spinning head for the monofilaments, at least one spinning plate with a plurality of nozzle orifices, one or more spinning pumps which are each driven by a motor, the spinning pump motor being connected to controller to control the diameter of the monofilaments, wherein measurements of the diameters of the individual monofilaments are fed into said controller, the improvement wherein:

from 6 to 60 nozzle orifices are combined into a group of nozzle orifices;

each of the groups of nozzle orifices has its own said spinning pump with its own said controller a measuring device for measuring the diameters of the individual monofilaments conducted through the measuring device and for calculating an average of the diameters of the individual monofilaments; and the controller being fed the average of the diameter measurements as an actual value signal which controls the spinning pump of the respective nozzle orifice group.

5. The improvement defined in claim 4 wherein:

the average is calculated by a computer within the measuring device.

6. The improvement defined in claim 1 wherein an algebraic average of the monofilaments of a nozzle orifice group is supplied as the actual value signal into the controller of the respective spinning pump.

* * * * *